US005273509A

United States Patent [19]

Vittone

[11] Patent Number: 5,273,509

[45] Date of Patent: Dec. 28, 1993

[54] HANDLE FOR EXERCISE MACHINES

[76] Inventor: Larry W. Vittone, Rte. 2, Box 23, Ollis Rd., Oliver Springs, Tenn. 37840

[21] Appl. No.: 567

[22] Filed: Jan. 4, 1993

Related U.S. Application Data

[63] Continuation of Ser. No. 738,251.

[51] Int. Cl.[5] ..... A63B 21/00

[52] U.S. Cl. ..... 482/139; 482/99; 482/101; 482/130

[58] Field of Search ..... 482/45, 93, 117, 118, 482/102, 103, 139, 906, 121-130; 403/86; 16/110 R, 121, 122, 123

[56] References Cited

U.S. PATENT DOCUMENTS

| | | | |
|---|---|---|---|
| 2,508,567 | 5/1950 | Dymeck . | |
| 3,124,971 | 3/1964 | Peters et al. | 403/56 X |
| 3,384,370 | 5/1968 | Bailey et al. . | |
| 3,428,311 | 2/1969 | Mitchell | 482/45 |
| 3,588,102 | 6/1971 | Gifford . | |
| 3,782,721 | 1/1974 | Passera | 482/118 |
| 3,904,198 | 9/1975 | Jones . | |
| 4,149,713 | 4/1979 | McLeod | 482/101 |
| 4,249,727 | 2/1981 | Dehan | 482/118 |
| 4,461,473 | 7/1984 | Cole . | |
| 4,585,229 | 4/1986 | Brasher . | |
| 4,603,856 | 8/1986 | Fiore | 482/114 |
| 4,618,143 | 10/1986 | Twardosz . | |
| 4,629,184 | 12/1986 | Selkee . | |
| 4,684,122 | 8/1987 | Desmonn et al. | 482/105 |
| 4,720,096 | 1/1988 | Rogers | 482/93 X |
| 4,743,018 | 5/1988 | Eckler . | |
| 4,822,035 | 4/1989 | Jennings et al. . | |
| 4,836,535 | 6/1989 | Pearson . | |
| 4,901,999 | 2/1990 | Schott | 482/117 X |
| 4,915,396 | 4/1990 | Chaisson | 482/906 X |
| 4,949,957 | 8/1990 | Cucchiara | 482/105 |
| 4,974,836 | 12/1990 | Hirsch | 482/98 |
| 5,076,578 | 12/1991 | Askoden | 482/139 |
| 5,151,070 | 9/1992 | Norman | 482/101 |

FOREIGN PATENT DOCUMENTS

| | | | |
|---|---|---|---|
| 3444880 | 6/1986 | Fed. Rep. of Germany . | |
| 919472 | 11/1946 | France | 403/56 |
| 223926 | 6/1985 | German Democratic Rep. . | |
| 249403 | 7/1926 | Italy | 403/56 |
| 943191 | 12/1963 | United Kingdom | 403/56 |

OTHER PUBLICATIONS

Advertisement; Muscle & Fitness Magazine; Sep., 1990.

*Primary Examiner*—Robert Bahr

*Attorney, Agent, or Firm*—Luedeka, Hodges, Neely & Graham

[57] ABSTRACT

The application discloses a handle for an exercise machine having a force resistor such as the cable type wherein a weight stack supplies resistance to movement of the handle along a path through an interconnecting cable system. The handle includes a grip supported on an elongate arm. A base includes structure for connecting the handle to the force resistor. A ball joint connects the arm to the base to enable simultaneous rotation of the arm about its length axis and pivotal movement of the arm in an orbital fashion relative to the base to provide an expanded range of positions of the user's hand during opposed movement of the handle along the path.

9 Claims, 3 Drawing Sheets

HANDLE FOR EXERCISE MACHINES

This is a continuation of application Ser. No. 07/738,251, filed Jul. 30, 1991, now abandoned.

This invention relates generally to exercise machines and components thereof, and more particularly relates to a handle for exercise machines which provides an enhanced and expanded range of movement of the user's hands during the employment of the handle in the movement of a force resistor of the machine.

Many exercise machines are devised to supply resistance to movement of a handle by a user along a path. One such machine is the so called "universal gym" which contains several weight/pulley stations within a single frame. One or more of these stations may employ a handle of some type which is gripped by a user to apply a lifting, pushing or pulling force to the weights through the connecting cable, allowing continuously opposed movement of the handle along a path as the weights and cable are moved by the handle. The cable is typically trained over pulleys so that the user is horizontally shifted from the weights and positioned in a relatively open, unobstructed space and the cable may lead to the handle position from above or below the user's hands. Thus, the path of movement of the handle is generally vertical.

In another type of exercise machine, the handle portion is employed in a similar manner but the force resistor consists of an elastomeric member. In other cases, the handle may be attached directly to the weights such as in a bench press machine.

In these and other handle operated exercise machines, the handle portion often consists of an elongate rigid bar with grips on its opposite ends, and a connector midway along its length for attachment to the free end of the cable. The user stands or sits with his hands on the grips at the opposite ends of the handle and pulls it up or down against the force of the weights along a path of movement. Alternately, the handle portion may consist of two parts so that the hands can be used independently to exert a pulling or pushing force upon the weights resulting in movement of the handles through their respective paths.

Conventional handles for such machines cause the hands to remain in a more or less fixed orientation relative to the path of movement of the handle as the weights are moved up and down. Or, in another respect, the user is unable to adjust the orientation of the line of force from his hands to the force supplying the resistance. Accordingly, the user is unable to adjust the hand disposition to optimize a pulling or pushing force, change the line of force to effect different muscle groups or achieve a more comfortable grip during the performance of a movement cycle.

It is therefore an object of the invention to provide a handle for exercise machines and the like.

Another object of the invention is provide a handle for an exercise machine to enable adjustment of the position of the user's hands relative to the line of force during movement of the handle along a path in opposition to a force resistor.

Still another object of the invention is to provide a handle of character described to enable an expanded range of positions of the user's hands during movement of the handle along its path.

Yet another object of the invention is to provide a handle of the character described which is adaptable for use in a wide variety of applications and exercise machines.

A further object of the invention is the provision of a handle of the character described which is relatively uncomplicated in construction and easy to use.

The invention resides in a handle for an exercise machine of the type which contains a force resistor for opposing movement of the handle by a user along a path. The handle comprises an elongate arm having a length axis and first and second opposite ends, and a grip supported on the arm adjacent its first end. A base includes means for connecting the handle to the force resistor and a ball joint connects the second end of the arm to the base to enable simultaneous rotation of the arm about its length axis and pivotal movement of the arm in an orbital fashion relative to the base to provide an expanded range of positions of the user's hand during opposed movement of the handle.

In a preferred embodiment, the handle is configured to provide for two-handed exercise wherein both of the user's hands are employed to move the handle along the path. In this embodiment, an additional grip and supporting arm are provided and are connected to the base with a second ball joint to provide movement in the same manner as the first grip and arm. Thus, a user may exert a force upon the handle through both grips and arms to independently adjust the position of his hands by rotation of the arms about their length axes and orbicular pivotal movement of the grip and arm relative to the base to achieve a greatly expanded range of positions of the hands and lines of force during exercise.

These and other features and advantageous of the invention will now be further described in the following specification of preferred embodiments in conjunction with the accompanying drawings in which.

Figure 1:
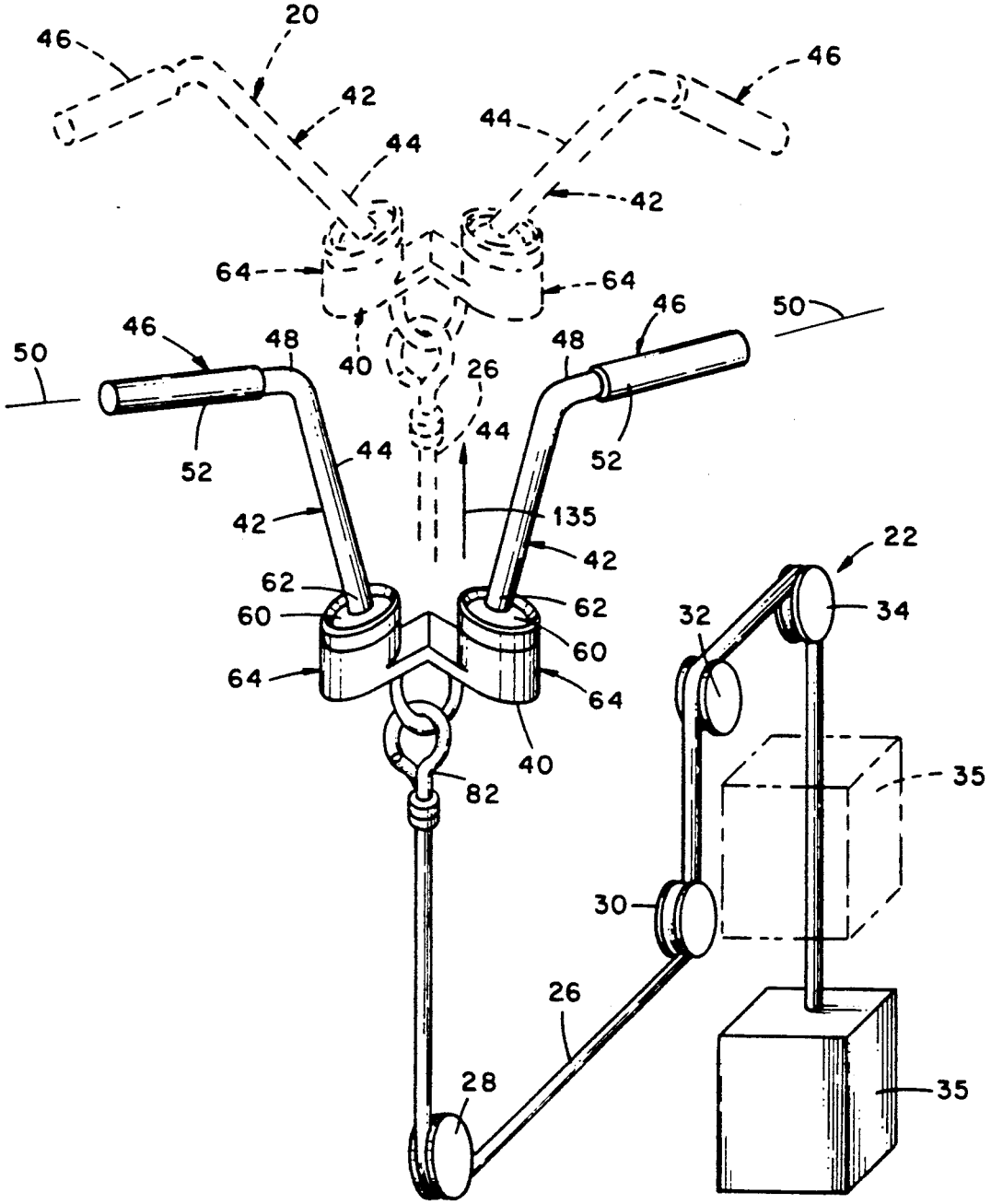
FIG. 1 illustrates a handle in accordance with a preferred embodiment of the invention and its use with an exercise machine shown diagrammatically for the purpose of illustration.

With reference now to the drawings in further detail wherein like reference characters designate like or similar parts throughout the several views, there is shown in FIG. 1 a handle 20 for use with an exercise machine 22, in this case a cable-type system, illustrated diagrammatically by a cable 26 trained over a series of pulleys 28, 30, 32 and 34 and connected to a weight 35.

The handle of this embodiment includes a base 40 which supports a pair of handlebars 42. Each handlebar 42 includes an elongate arm 44 and a grip 46 joined to the arm 44 at an elbow 48 so as to establish a fixed angular disposition of the grip relative to the arm.

The grip 46 of each handlebar 42 is disposed along a grip axis 50 and defines a gripping surface 52 whereby a user may grip the handlebar with the palm wrapped around the gripping surface and disposed along the grip axis. Preferably, the grip axis 50 is disposed at an angle in the range of from about 85° to about 115° with respect to the length axis of the arm 44, and in the embodiment of FIG. 1 the grip axis is most preferably disposed at an angle of about 110° with respect to the length axis of the arm.

In accordance with the invention, the arm 44 of the handlebar 42 and base 40 are joined together so as to enable rotation of the arm 44 generally about its length axis and simultaneous pivotal movement of the arm about the base in an orbital fashion. In a preferred embodiment and with reference to FIGS. 1 and 3, this is accomplished by providing a ball joint connection between the handlebar 42 and base 40 through the use of a ball 60 located on the outboard end 62 of the shanks. The ball 60 is engagingly received within a cylindrical housing 64 located on the base 40.

Figure 2:
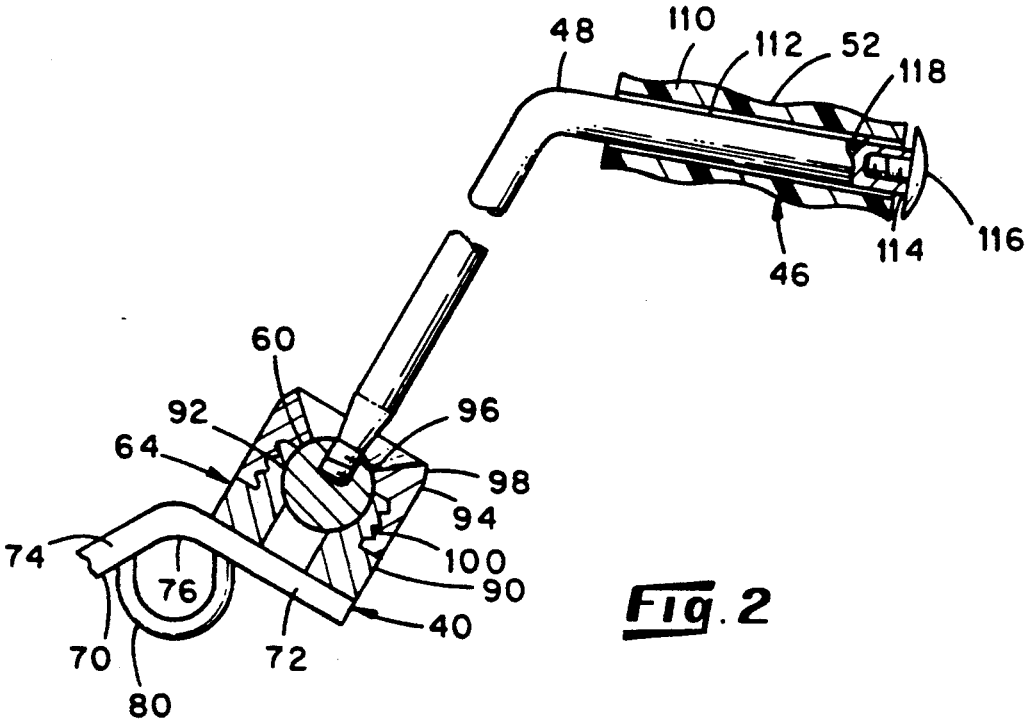
FIG. 2 is a fragmentary view, partially in section, of a portion of the handle shown in FIG. 1.

With reference to FIG. 2, the base 40 in the illustrated embodiment includes an angular plate 70 providing right and left-hand lobes 72 and 74, respectively, and a bend 76 therebetween. Accordingly, the lower surfaces of the lobes 70 and 72 are disposed at an acute angle with respect to one another and the upper surfaces of the lobes 72 and 74 are disposed at an obtuse angle with respect to one another. The opposite ends of a loop 80 are attached to the undersurfaces of the lobes 72 and 74 to provide for attachment of the handle 22 to the end of the cable 26 as by a hook 82 shown in FIG. 1.

The housings 64 are disposed on the upper surfaces of the lobes 72 and 74 of the base 40 at an obtuse angle with respect to one another as generally defined by the bend 76 in the plate 70. The angle of the bend 76 is selected in conjunction with the length of the arms 44 of the handlebars 42 so as to cause the handlebars 42 to generally diverge from one another when the arms 44 are disposed with their length axes substantially parallel to the length axes of the housings 40 supporting the respective bars. The degree of divergence is such that the grips 46 in the aforesaid disposition of the handlebars 42 are spaced comfortably for being grasped by the hands of a user for exerting a force upon the handle.

In a preferred embodiment, the construction of the housing 64 may include a lower section 90 defining an upwardly facing hemispherical depression 92 having a radius in conformity with that of the ball 60 on the end of the arm 44 so that the ball fits into the depression with substantial continuous surface-to-surface contact between the parts to thereby facilitate smooth rotational and orbital movement of the ball in the depression. An upper section 94 of the housing 64 is disposed atop the lower section 90 and includes a central circular opening through its upper surface that communicates or extends to a downwardly facing hemispherical depression 98 having a radius substantially equal to that of the upwardly facing depression 92 in the lower section 90. The upper section 94 is attached to the lower section 90 as by a threaded engagement indicated at 100 therebetween such that their respective hemispherical depressions 98 and 92 together define a spherical space or socket within which the ball 60 is confiningly received for movement in the aforedescribed manner.

Figure 3:
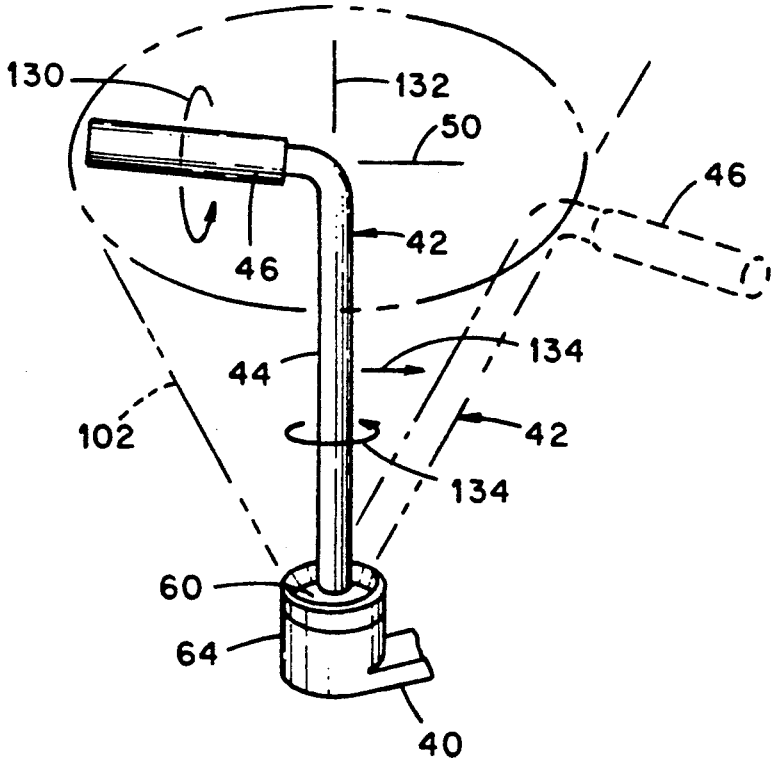
FIG. 3 is a fragmentary view of the handle shown in FIG. 1 illustrating an expanded range of positions of a grip portion as provided by the construction of the handle.

The portion of the arm 44 adjacent the ball 60 projects upwardly through the opening 96 in the upper section 94 and the diameter and configuration of the opening accommodates movement of the arm 44 within an upwardly directed cone-shaped space 102 as illustrated in FIG. 3. Thus, the arm 44 pivots about a point located essentially at the center of the ball 60 as the handlebar 42 is moved between positions in the cone-shaped space 102 so that the arm 44 and grip 46 are movable in an orbital fashion between the positions in the space.

As a further feature, the grip 46 may be configured so that it is rotatable about the grip axis 50. Preferably, this is accomplished providing the grip in the form of a sheath 110 as shown in FIG. 2 which is received onto a short cylindrical section 112 of the handlebar 42 extending from the bend 48. The inside diameter of the sheath 110 is slightly greater than that of the section 112 so that the sheath can rotate thereon. The sheath is prevented from moving off of the section by a retainer ring 114 and a cap 116. The retainer ring 114 is received within a correspondingly dimensioned detent 118 in the section 11 and the cap 116 is threadably secured to the end of the section to support the ring 114 and sheath 110 against longitudinal movement.

Thus, with reference to FIG. 3, it will be seen that the features of the invention combine to enable several types of movement in different directions simultaneously, if desired, to provide an expanded range of hand positions during an exercise. For example, the invention enables rotation of the grip 46 about the grip axis 50 as shown by arrow 130, rotation of the grip 46 and arm 44 about a length axis 132 the arm 44 as shown by arrow 134, and pivotal movement of the grip 46 and arm 44 in an orbital fashion about the center of ball 60 as shown by arrow 134, all singly or in unison. In this connection, as illustrated in FIG. 1, the handle 20 will be seen to further enable a spreading apart or divergence of the user's hands as the handle is moved in the direction of arrow 135 as can be seen by comparing the positions of the handle bars 44 after movement of the handle to the position shown by the ghost outline. The grips can also be rotated about grip axes 50 and about the length axes 132 of the arms 44. Thus, the user can bring many different muscles into play as the weights are moved to expand the effectiveness of the exercise.

Figure 4:
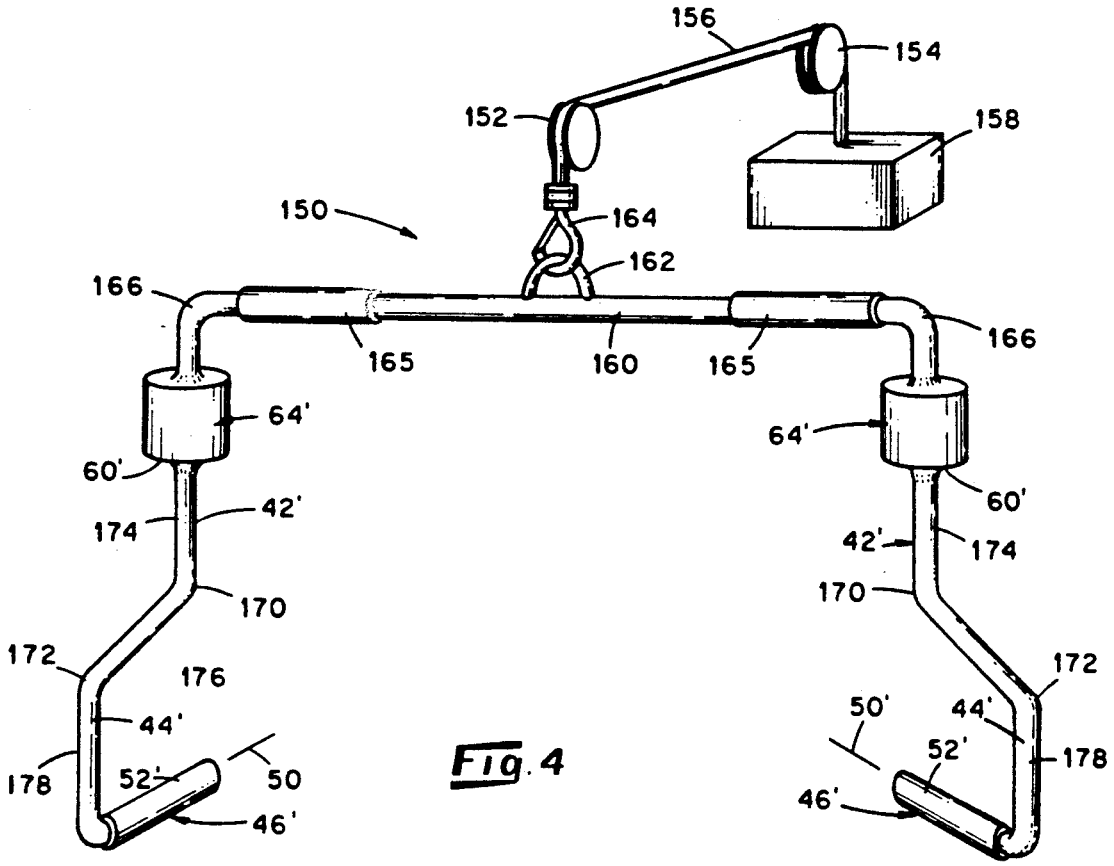
FIG. 4 is a view similar to that of FIG. 1 illustrating another embodiment of the handle of the present invention.

With reference now to FIG. 4, an alternate embodiment of the handle designated as 150 is disclosed for use with a force resisting means consisting of a pair of pulleys 152 and 154 and a cable 156 trained over the pulleys to connect the handle with a weight 158. This embodiment is particularly well adapted for use in pulling downwardly as in a "lat-pull". Elements of the handle 150 corresponding to elements of the embodiment 22 previously described will be referenced with the same characters using a prime suffix.

The handle 150 of the FIG. 4 embodiment includes a cross bar 160 having a loop 162 located midway along its length between its opposite ends. The loop provides a means for attachment of the handle 150 to a hook 164 which is located at the end of the cable 156. A pair of pads 165 on the bar 160 provide a cushion against the user's shoulders.

Each opposite end of the cross bar 160 is downturned as by bends 166 and supports a depending housing 64'. Each housing 64' in turn engagingly receives a ball end 60' of a handlebar 42' including an arm 44' and a grip 46' disposed along a grip axis 50'.

The arm 44' of the handlebar 42' includes first and second bends 170 and 172 whereby the arm 44' is divided into three segments 174, 176 and 178. It will be seen that the segments 174 and 178 are separated by middle segment 176 and are disposed along generally parallel axes shifted laterally with respect to one another by bends 170 and 172 and middle segment 176, which is disposed at an angle with respect to the segments 174 and 178 preferably in the range of from about 115° to about 145°.

The grip axis 50' of each handlebar 142' is preferably disposed substantially perpendicular to the axes of the segments 174 and 178 and the shifting of the segment 178 relative to the segment 174 is preferably sufficient to cause the longitudinal axis of the segment 174 closest to ball end 60' to intersect the grip portion 46' at a location generally midway along the length of the gripping surface 52'. Accordingly, the longitudinal axis of the segment 174 which corresponds to the length axis 132 of the arm 44 of FIG. 3 will, in this embodiment, pass through the user's hand placed upon the gripping surface 52'. This is an advantageous arrangement of the hands along the lines of force exerted upon the handle 150 by the user and is a feature that may be employed in other embodiments of the invention.

In the embodiment of FIG. 4, the housings 64' receive the ball ends 60' in the same manner as described above in connection with FIGS. 1 through 3 to enable pivoting movement of the handlebars 44' in an orbital fashion about the ball ends 60' and simultaneous rotation about the axes of the segments 174. The grips 46' also may be rotatable about grip axes 50' as described in connection with FIG. 2. However, in this embodiment the housings 64' and the handlebars 42' are spaced apart to a greater extent than in the FIG. 1 embodiment, being at opposite ends of the cross bar 160, which may have a length in the order of 3 to 4 feet.

Figure 5:
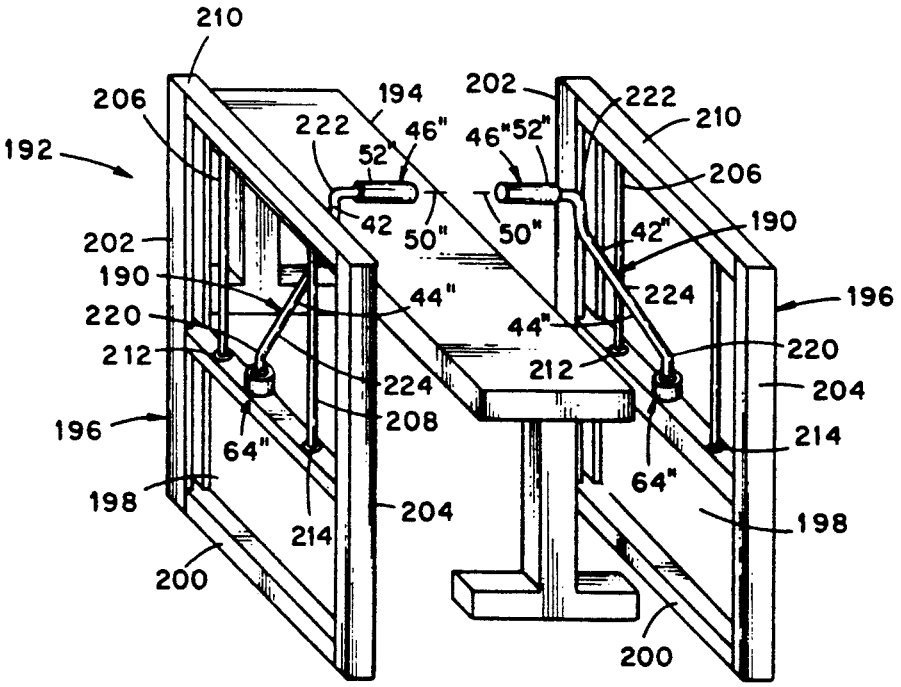
FIG. 5 is a perspective view illustrating a further embodiment of the handle of the invention.

A further embodiment of the invention is illustrated in FIG. 5 where a pair of handles 190 are employed in a bench press machine 192 consisting of a bench 194 for supporting a user in a horizontal or horizontally inclined position and a pair of side frames 196. Elements of the handles 190 corresponding to elements of the handles 20 previously described will be referenced with the same characters using a double prime suffix.

Each side frame 196 of the machine 192 incorporates a stack of weights 198 which is supported at rest adjacent a lower cross member 200. The weights 198 move vertically between upstanding side rails 202 and 204 and are guidingly supported for movement therebetween by spaced apart vertically oriented rods 206 and 208 which extend between each lower cross member 200 and an upper cross member 210 extending across and between the side rails 202 and 204. The rods 206 and 208 are received in aligned openings 212 and 214 extending through the weight stacks 198.

In the embodiment of FIG. 5, the handles 190 consist of a handlebar 42" and a housing 64" attached to the top of the weight stack 198 by suitable means. Each handlebar 42" in turn includes an arm 44" containing lower and upper bends 220 and 222 defining an elongate center segment 224 and bends 223 in the center segments 224 adjacent the upper bends 222. The handlebars 42" further include grips 46" outboard of the upper bends 222. The grips 46" define gripping surfaces 52" whereby a user grips the handlebar along gripping axes 50". The length of the center segment 224 of each handlebar 44" and the angle of the bends 220, 222 and 223 are sufficient to shift the position of the grips 46" out away from the side frames 196 and to dispose the gripping axes 50" at a position above the surface of the bench 194 in a generally horizontal altitude so that the gripping surfaces 52" can be gripped by the hands of the user in a lowered or cocked position when the weight stacks 192 are at rest upon the lower cross members 200. Thereafter, the user exerts an upward force upon the weight stacks 198 to elevate the weights along the frame as the weights are guidingly supported by the rods 206 and 208. The grip axes 50" in the FIG. 5 embodiment are preferably disposed at an angle of about 110° relative to the length axes of the lower sections of the center segments 224 of their associated arms 44" as viewed from the position of the user on the bench 194.

As in the embodiment of FIG. 4, the housings 64" of the embodiment of FIG. 5 engagingly receive the ball ends 60" of the arms 44" of the handlebars 42" to enable pivotal movement of the arms and grips in an orbital fashion about the ball ends and simultaneous rotation of the handlebars 44" generally about the longitudinal axes of the center segments 224. This movement enables the user to adjust the position of his or her hands with respect to the weights to achieve different forms of exercise and to alter the lines of force applied to the weights during movement.

Although preferred embodiments of the aforementioned have been described in the foregoing detailed description, it will be understood that the invention is capable of numerous rearrangements, modifications and substitutions without departing from the scope and spirit of the appended claims.

What is claimed:

1. An exercise machine comprising:

a stationary frame fixedly mounted on a support surface;

force resistance means movable along a path between first and second positions while connected to the frame to provide a resistance force opposing movement of said force resistance means between said first and second positions; and handle means for transmitting force from a user to said force resistance means to move said force resistance means between said first and second positions, said handle means comprising:

a base including means for connecting said handle means, to said force resistance means so that said base moves in a direction generally parallel to the direction of force applied to said force resistance means through said handle means by the user during opposed movement of said force resistance means between said first and second positions, a pair of elongate arms each having a length axis and first and second ends, a pair of grips for being gripped by the hands of the user, said grips supported on said arms adjacent said first ends of said arms, and a pair of ball joints located on said base for connecting said arms to said base adjacent said second ends of said arms, each ball joint providing for simultaneous rotation of its associated arm about its length axis and pivotal movement of the arm in an orbital fashion relative to said base to thereby provide an expanded range of positions of the user's hands upon said grips during opposed movement of said force resistance means between said first and second positions.

2. The handle of claim 1, wherein said base includes an elongate bar having opposite ends with said means for connecting located generally midway between said opposite ends and said ball joints supported on said bar adjacent its opposite ends.

3. The handle of claim 1, wherein said base is provided by said force resistor such that said ball joint connects said arm to said force resistor.

4. The handle of claim 1, wherein said grips are disposed along grip axes and are rotatable about their respective grip axes.

5. The handle of claim 1, wherein said grips are disposed along grip axes and the angle between said grip axes and the length axes of their associated arms are fixed in the range of from about 85° to about 115°.

6. The handle of claim 1, wherein said base is provided by spaced apart weights with said ball joints connecting said arms to said weights.

7. The exercise machine of claim 1 wherein said force resistance means comprises a cable trained over a series of pulleys and connected to a weight.

8. The exercise machine of claim 1 wherein said force resistance means comprises a stack of weights vertically movable between upstanding frame members.

9. The exercise machine of claim 1 wherein said force resistance means comprises an elastomeric member.

* * * * *